US010629983B2

(12) United States Patent
Zhang et al.

(10) Patent No.: US 10,629,983 B2
(45) Date of Patent: Apr. 21, 2020

(54) ANTENNA SYSTEM AND MOBILE TERMINAL

(71) Applicant: AAC Technologies Pte. Ltd., Singapore (SG)

(72) Inventors: Liwan Zhang, Shenzhen (CN); Kai Dong, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 209 days.

(21) Appl. No.: 15/828,572

(22) Filed: Dec. 1, 2017

(65) Prior Publication Data

US 2018/0375193 A1 Dec. 27, 2018

(30) Foreign Application Priority Data

Jun. 22, 2017 (CN) ..... 2017 1 0482126

(51) Int. Cl.

| | |
|---|---|
| ***H01Q 1/24*** | (2006.01) |
| ***H01Q 1/38*** | (2006.01) |
| ***H01Q 5/335*** | (2015.01) |
| ***H01Q 5/30*** | (2015.01) |
| ***H01Q 5/50*** | (2015.01) |
| ***H01Q 9/42*** | (2006.01) |
| ***H01Q 21/28*** | (2006.01) |
| ***H01Q 5/378*** | (2015.01) |
| ***H01Q 5/40*** | (2015.01) |

(Continued)

(52) U.S. Cl.

CPC ..... *H01Q 1/243* (2013.01); *H01Q 1/38* (2013.01); *H01Q 5/30* (2015.01); *H01Q 5/335* (2015.01); *H01Q 5/35* (2015.01); *H01Q 5/378* (2015.01); *H01Q 5/40* (2015.01); *H01Q 5/50* (2015.01); *H01Q 9/42* (2013.01); *H01Q 21/28* (2013.01); *H01Q 1/521* (2013.01)

(58) Field of Classification Search

CPC ..... H01Q 1/243; H01Q 1/38; H01Q 1/521; H01Q 5/30; H01Q 5/378; H01Q 5/40; H01Q 9/42; H01Q 21/28

See application file for complete search history.

(56) References Cited

U.S. PATENT DOCUMENTS

| | | | | |
|---|---|---|---|---|
| 9,450,296 | B2 * | 9/2016 | Lin | H01Q 1/243 |
| 10,038,234 | B2 * | 7/2018 | Tseng | H01Q 5/10 |

(Continued)

*Primary Examiner* — Ab Salam Alkassim, Jr.
(74) *Attorney, Agent, or Firm* — IPro, PLLC; Na Xu

(57) ABSTRACT

An antenna system, including a metal frame including a radiation portion and a grounding portion separately arranged, and a gap zone is defined therebetween; a main board including a system ground, a first radio frequency feeding end and a second radio frequency feeding end; a first conductive member; a second conductive member; a three-in-one antenna unit; and a diversity antenna unit; the three-in-one antenna unit is connected with the first radio frequency feeding end, and the diversity antenna unit is electrically connected with the second radio frequency feeding end; the three-in-one antenna unit and the diversity antenna unit are connected with the radiation portion respectively through the first conductive member and the second conductive member; the radiation portion includes a first grounding point and a second grounding point which are connected with the system ground and arranged between the diversity antenna unit and the three-in-one antenna unit.

10 Claims, 7 Drawing Sheets

(51) Int. Cl.
*H01Q 5/35* (2015.01)
*H01Q 1/52* (2006.01)

(56) References Cited

U.S. PATENT DOCUMENTS 10,224,603 B2 * 3/2019 Shin ..... H01Q 1/241
10,283,858 B2 * 5/2019 Xue ..... H01Q 5/385
10,374,290 B2 * 8/2019 Heo ..... H01Q 9/42
10,403,964 B2 * 9/2019 Yoo ..... H01Q 21/28
10,461,425 B2 * 10/2019 Liou ..... H01Q 5/371
2012/0262345 A1 * 10/2012 Kim ..... H01Q 1/243 343/702
2014/0078008 A1 * 3/2014 Kang ..... H01Q 5/35 343/702
2014/0111381 A1 * 4/2014 Lin ..... H01Q 9/04 343/700 MS
2014/0292590 A1 * 10/2014 Yoo ..... H01Q 1/243 343/702
2015/0188212 A1 * 7/2015 Tseng ..... H01Q 1/243 343/702
2015/0188213 A1 * 7/2015 Lin ..... H01Q 1/243 343/702
2015/0349404 A1 * 12/2015 Wang ..... H01Q 5/314 343/702
2016/0064820 A1 * 3/2016 Kim ..... H01Q 1/243 343/767
2016/0118710 A1 * 4/2016 Shin ..... H01Q 1/241 343/702
2017/0047641 A1 * 2/2017 Kim ..... H01Q 1/243
2017/0048363 A1 * 2/2017 Lee ..... H01Q 1/243
2017/0155186 A1 * 6/2017 Lin ..... H01Q 1/243
2017/0237151 A1 * 8/2017 Andujar Linares ..... H01Q 1/38 343/702
2017/0294709 A1 * 10/2017 Xue ..... H01Q 5/385
2018/0026332 A1 * 1/2018 Lin ..... H01Q 1/243 343/872
2018/0026334 A1 * 1/2018 Chen ..... H01Q 1/243 343/702
2018/0026335 A1 * 1/2018 Lee ..... H01Q 1/243 343/702
2018/0026336 A1 * 1/2018 Chen ..... H01Q 1/243 343/702
2018/0026337 A1 * 1/2018 Chen ..... H01Q 1/243 343/702
2018/0026338 A1 * 1/2018 Lin ..... H01Q 1/243 343/702
2018/0026350 A1 * 1/2018 Hung ..... H01Q 9/0421 455/575.7
2018/0026353 A1 * 1/2018 Tseng ..... H01Q 9/42 455/575.7
2018/0026360 A1 * 1/2018 Lee ..... H01Q 1/243 343/872
2018/0062244 A1 * 3/2018 Huang ..... H01Q 5/10
2018/0115054 A1 * 4/2018 Wu ..... H01Q 5/35
2018/0123234 A1 * 5/2018 Wang ..... H01Q 1/2291
2018/0248250 A1 * 8/2018 Hsu ..... H01Q 9/30
2018/0261921 A1 * 9/2018 Ha ..... H01Q 1/243
2018/0358698 A1 * 12/2018 Wang ..... H01Q 9/42
2018/0375194 A1 * 12/2018 Zhang ..... H01Q 1/243
2018/0375195 A1 * 12/2018 Liu ..... H01Q 1/243
2019/0198975 A1 * 6/2019 Chen ..... H01Q 1/243
2019/0207297 A1 * 7/2019 Gu ..... H01Q 1/243
2019/0214714 A1 * 7/2019 Chen ..... H01Q 1/243
2019/0252764 A1 * 8/2019 Liao ..... H01Q 1/243

* cited by examiner

ANTENNA SYSTEM AND MOBILE TERMINAL

TECHNICAL FIELD

The present disclosure relates to the field of communications technologies and, particularly, relates to an antenna system and a mobile terminal

BACKGROUND

At present, when designing an antenna system for a mobile terminal having a metal frame, an active antenna unit at a radio frequency feeding end on the main board is generally adopted as a first radiator of the antenna system. The antenna unit is indirectly coupled with the metal frame, so that the metal frame serves as a second radiator. Through cooperation of the two radiators, resonance generated by the antenna system can satisfy bandwidth requirements.

However, such a manner has requirements on the coupling distance between the antenna unit and the metal frame, when the display screen of the mobile terminal adopts a curved screen, a position for adhering the curved screen will occupy the coupling space between the antenna unit and the metal frame. Therefore, the coupling excitation effect between the antenna system and the metal frame will be influenced, which may influence radiation performance of the antenna system. In addition, a clearance area on the main board will also influence the coupling excitation between the antenna unit and the metal frame. Specifically, the smaller the clearance area on the main board is, the more the metal elements arranged on the main board is. These metal elements may cause decreasing of the coupling excitation effect between the antenna unit and the metal frame, leading to poor radiation performance of the antenna system.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

REFERENCE SIGNS

10—metal frame;
- 100—radiation portion;
  - 100*a*—first grounding point;
  - 100*b*—second grounding point;
- 101—grounding portion;
- 102—first fracture;
- 103—second fracture;

20—main board;
30—first conductive member;
40—second conductive member;
- 400—first conductive portion;
- 401—second conductive portion;

50—three-in-one antenna unit;
- 500—first sub-section;
- 501—second sub-section;

60—diversity antenna unit;
- 600—first sub-unit;
- 601—second sub-section;
  - 601*a*—connecting section;
  - 601*b*—extending section;

80—WIFI 5G antenna unit;
- 801—main branch;
- 802—first sub-branch;
- 803—second sub-branch;
- 804—third sub-branch;

90—third conductive member;
91—connecting member;
920—first parallel inductance element;
921—second parallel inductance element;
922—first serial capacitance element;
923—first terminal;
924—second terminal;
930—third parallel inductance element;
931—second serial capacitance element;
932—third terminal;
933—fourth terminal.

The drawings herein are incorporated into the description and form a part thereof, which show embodiments of the present disclosure, and are used to explain the principle of the present disclosure together with the description.

DESCRIPTION OF EMBODIMENTS

The present disclosure will be described in further detail with reference to the following embodiments and the accompanying drawings.

Figure 1:
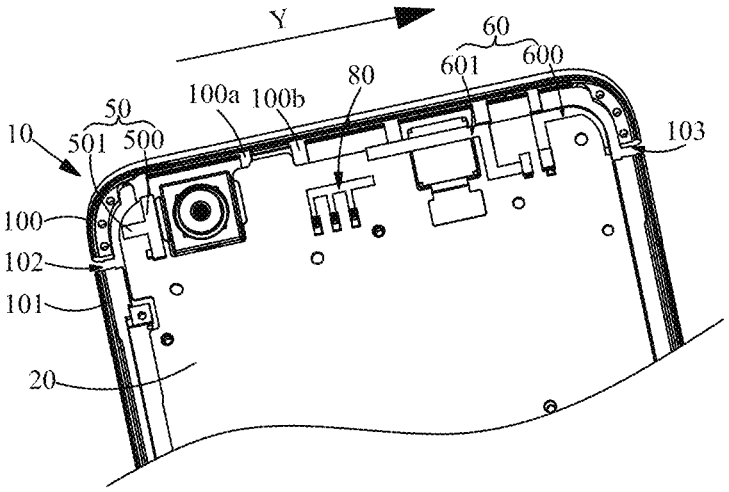
FIG. 1 is a structural schematic diagram of an antenna system in accordance with an exemplary embodiment of the present disclosure.
Figure 2:
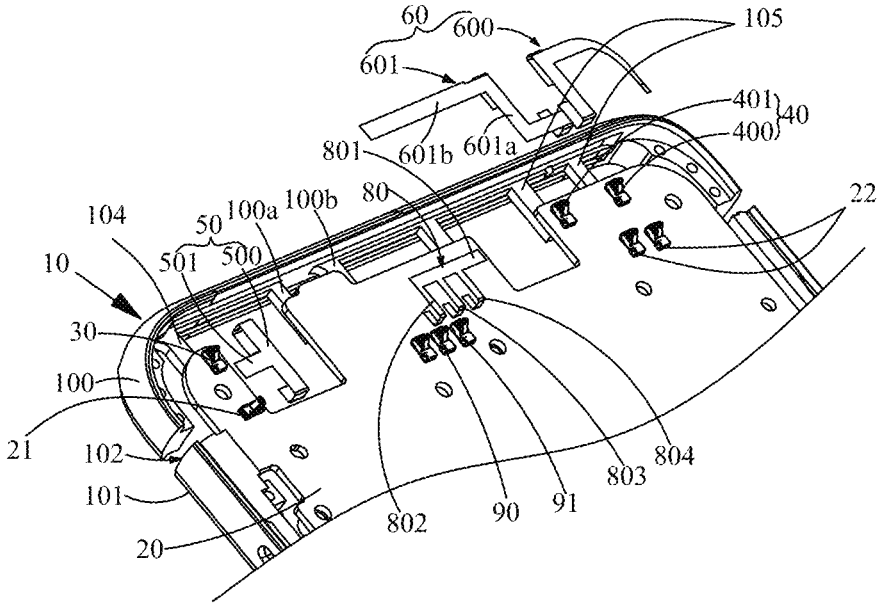
FIG. 2 is an exploded structural schematic diagram of an antenna system in accordance with an exemplary embodiment of the present disclosure.

As shown in FIG. 1 and FIG. 2, an exemplary embodiment of the present disclosure provides an antenna system, which can be applied in mobile terminals such as cellphone, the antenna system can include a metal frame 10, a main board 20, a first conductive member 30, a second conductive member 40, a three-in-one antenna unit 50 and a diversity antenna unit 60.

The main board 20 includes a system ground, a first radio frequency feeding end 21 and a second radio frequency feeding end 22 The three-in-one antenna unit 50 and the diversity antenna unit 60 can be made of conductive metal material, and both the three-in-one antenna unit 50 and the diversity antenna unit 60 serve as radiators of the antenna system. Specifically, the three-in-one antenna unit 50 can be connected with the first radio frequency feeding end, and the first radio frequency feeding end can excite the three-in-one antenna unit 50 to radiate. The diversity antenna unit 60 can be electrically connected with the second radio frequency feeding end, and the second radio frequency feeding end can excite the diversity antenna unit to radiate. Optionally, the three-in-one antenna unit 50 and the diversity antenna unit 60 can be electrically connected with the first radio frequency feeding end and the second radio frequency feeding end, respectively, through a spring pin, so as to guarantee the reliability of the connections between the three-in-one antenna unit 50 and the first radio frequency feeding end, and between the diversity antenna unit 60 and the second radio frequency feeding end.

In addition, the above-mentioned metal frame 10 can include a radiation portion 100 and a grounding portion 101 which are arranged separately. The grounding portion 101 can be connected with the system ground, so as to serve as a reference ground of the antenna system. The three-in-one antenna unit 50 and the diversity antenna unit 60 can be connected with the radiation portion 100 respectively through the first conductive member 30 and the second conductive member 40, so as to excite the radiation portion 100 to radiate. That is, the radiation portion 100, the three-in-one antenna unit 50 and the diversity antenna unit 60 together serve as a radiator of the antenna system. In detail, the metal frame 10 includes a first extending beam 104 and a second extending beam 105 extending from the radiation portion 100. The three-in-one antenna unit 50 is connected with the radiation portion 100 by the first conductive member 30, the main board 20, and the first extending beam 104. The diversity antenna unit 60 is connected with the radiation portion 100 by the second conductive member 40, the main board 20, and the second extending beam 105.

In the present embodiment, since the three-in-one antenna unit 50 and the diversity antenna unit 60 are connected with the radiation portion 100 respectively through the first conductive member 30 and the second conductive member 40 so as to excite the radiation portion 100, compared with the manner that the antenna unit excites the metal frame 10 through indirect coupling, such manner of exciting radiation portion 100 provided by the present embodiment does not have too much requirements on the distance between the antenna unit and the metal frame 10 and the clearance area on the main board 20. That is, the distance between the antenna unit and the metal frame 10 and clearance area on the main board 20 will not influence the exciting effect between the antenna system and the metal frame 10, so as to improve the radiation performance of the antenna system.

It should be noted that, there is a gap zone between the radiation portion 100 and the grounding portion 101. The gap zone can be filled with an insulation material. Such a design is beneficial to radiation of the antenna system, and can guarantee the structural strength and security of the mobile terminal.

In addition, the above-mentioned radiation portion 100 has a first grounding point 100*a* and a second grounding point 100*b* which are connected with the system ground. The first grounding point 100*a* and the second grounding point 100*b* are arranged between the diversity antenna unit 60 and the three-in-one antenna unit 50, so as to improve insulation between the diversity antenna unit 60 and the three-in-one antenna unit 50.

Specifically, the above-mentioned gap zone has a first fracture 102 and a second fracture 103 arranged opposite to each other. The first fracture 102 and the second fracture 103 can be arranged opposite to each other along a length direction of the radiation portion 100. Such a design can improve appearance of the mobile terminal having the metal frame 10, and can reduce processing difficulty of the metal frame 10 so as to improve processing efficiency. The above-mentioned three-in-one antenna unit 50 is located between the first fracture 102 and the diversity antenna unit 60, and the diversity antenna unit 60 is located between the three-in-one antenna unit 50 and the second fracture 103. Compared with the second grounding point 100*b*, the first grounding point 100*a* is closer to the three-in-one antenna unit 50. That is, the first fracture 102, the three-in-one antenna unit 50, the first grounding point 100*a*, the second grounding point 100*b*, the diversity antenna unit 60 and the second fracture 103 are successively arranged along the length direction of the radiation portion 100. The length direction of the radiation portion 100 is Y direction shown in FIG. 1.

Based on the arrangement of the three-in-one antenna unit 50, the first grounding point 100*a*, the second grounding position 100*b* and the diversity antenna unit 60, in an exemplary embodiment of the present disclosure, the three-in-one antenna unit 50 includes a first sub-section 500 and a second sub-section 501. An end of the first section 500 can be connected with the radiation portion 100 through the first conductive member 30. The other end of the first sub-section 500 is connected with the first radio frequency feeding end. Optionally, the other end of the first sub-section 500 can be electrically connected with the first radio frequency feeding end through a metal plastic plate, so as to guarantee the connection reliability between the first sub-section 500 and the first radio frequency feeding end. The second sub-section 501 includes a connecting end and a free end, the connecting end is connected with the first sub-section 500, and the free end extends in a direction toward the first fracture 102. Such a design can appropriately increase a radiating length of the three-in-one antenna unit 50, so that the three-in-one antenna unit 50 generates multiple working frequency bands.

Specifically, the portion on the radiation portion 100 from the first grounding point 100*a* to the first fracture 102 and the first sub-section 500 can generate working frequency band of a GPS antenna. That is, the resonance generated by the portion on the radiation portion 100 from the first grounding point 100*a* to the first fracture 102 and the first sub-section 500 is located in the working frequency band of the GPS antenna, the length of the resonance is a half of the wave length of the GPS antenna. In addition, three-order resonances generated by the portion on the above-mentioned radiation portion 100 from the first grounding point 100*a* to the first fracture 102 and the first sub-section 500 are located in the working frequency band of the WIFI 5G antenna.

A portion on the radiation portion 100 from the first conductive member 30 to the first fracture 102 and the first sub-section 500 can generate a working frequency band of the WIFI 2.4G antenna and a bluetooth antenna. That is, the resonance generated by the portion on the radiation portion 100 from the first conductive member 30 to the first fracture 102 and the first sub-section 500 is located in the working frequency band of the WIFI 2.4G antenna and the bluetooth antenna, the length of the resonance is a half of the wave length of the WIFI 2.4G antenna and the bluetooth antenna.

A portion on the first sub-section 500 from the first radio frequency feeding end to the connecting end and the second sub-section 501 can generate a working frequency band of the WIFI 5G antenna. That is, the resonance generated by the portion on the first sub-section 500 from the first radio frequency feeding end to the connecting end and the second sub-section 501 is located in the working frequency band of the WIFI 5G antenna, the length of the resonance is a half of the wave length of the WIFI 5G antenna, and the resonance generated by the portion on the first sub-section 500 from the first radio frequency feeding end to the connecting end and the second sub-section 501 can facilitate to expand the band width of the WIFI 5G antenna in the three-in-one antenna together with the three resonances generated by the portion on the radiation portion 100 from the first grounding point 100*a* to the first fracture 102 and the first sub-section 500.

Based on the arrangement of the three-in-one antenna unit 50, the first grounding point 100*a*, the second grounding point 100*b* and the diversity antenna unit 60, in an exemplary embodiment of the present disclosure, the antenna system also includes a first capacitance element, and the second conductive member 40 also includes a first conductive portion 400 and a second conductive portion 401. The diversity antenna unit 60 also includes a first sub-unit 600 and a second sub-unit 601 which are spaced from each other. The first sub-unit 600 is located between the second sub-unit 601 and the second fracture 103. That is, along the length direction of the radiation portion 100, the second sub-unit 601, the first sub-unit 600 and the second fracture 103 are successively arranged. An end of the first sub-unit 600 is connected with the second radio frequency feeding end. Optionally, an end of the first sub-unit 600 can be electrically connected with the second radio frequency feeding end through a metal plastic plate, so as to guarantee the connection reliability between the first sub-unit 600 and the second radio frequency feeding end. The other end of the first sub-unit 600 is connected with the radiation portion 100 through the first connective portion 400.

The second sub-unit 601 includes a connecting section 601*a* and an extending section 601*b* connected with the connecting section 601*a*. The extending section 601*b* extends toward a direction away from the first sub-unit 600. An end of the connecting section 601*a* is connected with the radiation portion 100 through the second conductive portion 401. The other end of the connecting section 601*a* is connected with the system ground through the first capacitance element, the band width of the diversity antenna can be adjusted through adjusting the parameters of the capacitance element.

Based on the structure and the arrangement of the diversity antenna unit 60 and the radiation portion 100, the diversity antenna unit 60 and the radiation portion 100 can generate multiple working frequency bands, specifically:

A portion on the radiation portion 100 from the first conductive portion 400 to the second fracture 103 and the first sub-unit 600 can generate a first working frequency band. That is, the resonance generated by the portion on the radiation portion 100 from the first conductive portion 400 to the second fracture 103 and the first sub-unit 600 is located in the first working frequency band of the diversity antenna, and the length of the resonance is a half of the wave length of the first working frequency band.

A portion on the radiation portion 100 from the second grounding point 100*b* to the second fracture 103 and the first sub-unit 600 can generate a second working frequency band. That is, the resonance generated by the portion on the radiation portion 100 from the second grounding point 100*b* to the second fracture 103 and the first sub-unit 600 is located in the second working frequency band of the diversity antenna, and the length of the resonance is a half of the wave length of the second working frequency band.

A portion on the radiation portion 100 from the first conductive portion 400 to the second conductive portion 401, the first sub-unit 600 and the second sub-unit 601 can generate a third working frequency band. That is, the resonance generated by the portion on the radiation portion 100 from the first conductive portion 400 to the second conductive portion 401, the first sub-unit 600 and the second sub-unit 601 is located in the third working frequency band of the diversity antenna, and the length of the resonance is a half of the wave length of the third working frequency band.

A portion on the radiation portion 100 from the first conductive portion 400 to the second conductive portion 401, the first sub-unit 600 and the connecting section 601*a* can generate a fourth working frequency band. That is, the resonance generated by the portion on the radiation portion 100 from the first conductive portion 400 to the second conductive portion 401, the first sub-unit 600 and the connecting section 601*a* is located in the fourth working frequency band of the diversity antenna, and the length of the resonance is a half of the wave length of the fourth working frequency band.

The first working frequency band, the second working frequency band and the third working frequency band are all less than the fourth working frequency band. The second working frequency band, the third working frequency band are both less than the first working frequency band. The second working frequency band is less than the third working frequency band. Specifically, the first working frequency band is about 2100 MHz, the second working frequency band is in a range of 690 MHz-960 MHz, the third working frequency band is about 1710 MHz, and the fourth working frequency band is about 2400 MHz.

Based on the arrangement of the first grounding point 100*a*, the second grounding point 100*b* and the three-in-one antenna unit 50, optionally, the antenna system also includes a tuning switch. The tuning switch is arranged between the second grounding point 100*b* and second conductive member 40, and tuning switch is connected with the radiation portion 100 and the system ground. The tuning switch and the first capacitance have the effect of a substantially parallel arrangement, the effect influences the presentation of the first working frequency band, the third working frequency band and the fourth working frequency band. Generally, the first working frequency band and the third working frequency band together present a resonance, so as to increase the bandwidth. Through adjusting parameters of the tuning switch and the first capacitance element, due to the change in length of the equivalent resonance caused by parasitic effect, it is possible that the first working frequency band, the third working frequency band and the fourth working frequency band can generate partial resonance offset.

In an exemplary embodiment of the present disclosure, the antenna system also includes a WIFI 5G antenna unit 80, a third conductive member 90 and a connecting member 91. The main board 20 also includes a third radio frequency feeding end. The WIFI 5G antenna unit 80 is connected with the third radio frequency feeding end through the third conductive member 90. The WIFI 5G antenna unit 80 is connected with the system ground through the connecting member 91. Such a design can achieve multiple input multiple output function of the WIFI 5G antenna, and improve data utilization rate of the communication channel, so as to improve the radiation performance of the WIFI 5G antenna.

It should be noted that, the connecting member 91 and the third conductive member 90 can be spring pins, so as to guarantee the connection reliability between the WIFI 5G antenna unit 80 and the system ground and the third radio frequency feeding end.

The above-mentioned WIFI 5G antenna unit also includes a main branch 801 and a first sub-branch 802, a second sub-branch 803 and a third sub-branch 804 which are connected with the main branch 801. The first sub-branch 802, the second sub-branch 803 and the third sub-branch 804 all extend toward a direction away from the radiation portion 100, and the second sub-branch 803 is located between the first sub-branch 802 and the third sub-branch 804. The antenna system also includes a second capacitance element, the first sub-branch 802 is connected with the system ground through the second capacitance element, the second sub-branch 803 is connected with the third radio frequency feeding end through the third conductive member 90, and the third sub-branch 804 is connected with the system ground through the connecting member 91.

In an exemplary embodiment, a resonance path of the WIFI 5G antenna unit is added through loading the second capacitance element, which improves capacitive coupling effect of the WIFI 5G antenna unit, so that the WIFI 5G antenna unit can generate a double-resonance waveform, specifically:

A portion on the main branch 801 extending toward a direction from the second sub-branch 803 to the third sub-branch 804, the second sub-branch 803 and the third sub-branch 804 can generate a resonance (about 5700 MHz) of the WIFI 5G antenna, and the length of the resonance is a half of the wave length of the working frequency band of the WIFI 5G antenna.

A portion on the main branch 801 from the first sub-branch 802 to the third sub-branch 804, the first sub-branch 802, the second sub-branch 803 and the third sub-branch 804 can generate another resonance (about 5250 MHz) of the WIFI 5G antenna, and the length of the resonance is a half of the wave length of the working frequency band of the WIFI 5G antenna. Optionally, the WIFI 5G antenna unit 80 and the radiation portion 100 are spaced from each other, so as to reduce the influence of the radiation portion 100 to the WIFI 5G antenna, thereby improving the radiation performance of the WIFI 5G antenna unit 80.

It should be noted that, the WIFI 5G antenna and the three-in-one antenna cooperate with the first radio frequency front end and the second radio frequency front end, so that the antenna system can achieve multiple-input multiple-output (Multiple-Input Multiple-Output, MIMO) communication in the WIFI 5 GHz frequency band, so as to improve data utilization rate.

In an exemplary embodiment of the present disclosure, the three-in-one antenna unit 50, the diversity antenna unit 60 and the WIFI 5G antenna unit 80 can be as a flexible printed circuit (Flexible Printed Circuit, FPC) board, and can also be made through laser direct structuring (Laser Direct Structuring, LDS). In addition, a matching network can be provided to the three-in-one antenna unit 50 with the first radio frequency feeding end, connect the diversity antenna unit 60 with the second radio frequency feeding end, and connect the WIFI 5G antenna unit 80 with the third radio frequency feeding end. Through adjusting the parameters of the matching network, the band width of the three-in-one antenna, the diversity antenna and the WIFI 5G antenna can be adjusted, so as to achieve the impedance matching adjustment of the antenna.

Figure 3:
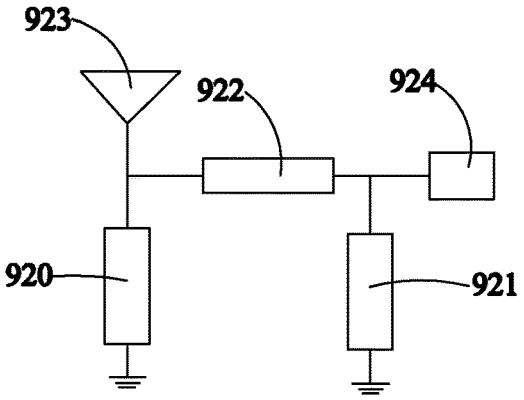
FIG. 3 is a structural schematic diagram of a matching network between a three-in-one antenna unit and a first radio frequency feeding end in an antenna system in accordance with an exemplary embodiment of the present disclosure.

Specifically, FIG. 3 of the present disclosure shows a matching network between the three-in-one antenna unit 50 and the first radio frequency feeding end. The matching network includes a first parallel inductance element 920, a second parallel inductance element 921, a first serial capacitance element 922, a first terminal 923 and a second terminal 924. The first terminal 923 is connected with the three-in-one antenna unit 50, the second terminal 924 is connected with the first radio frequency feeding end, a first serial capacitance element 922 is connected in series between the first terminal 923 and the second terminal 924. The first parallel inductance element 920 and the second parallel inductance element 921 are located between the first terminal 923 and the second terminal 924. An end of the first parallel inductance element 920 and an end of the second parallel inductance element 921 are respectively connected with the system ground, and the other end of the first parallel inductance element 920 and the other end of the second parallel inductance element 921 are respectively connected with two sides of the first serial capacitance element 922. The capacitance value of the first serial capacitance element 922 can be 0.7 pF, the inductance value of the first parallel inductance element 920 can be 7.5 nH, the inductance value of the second parallel inductance element 921 can be 3 nH. It should be noted that, the capacitance value of the first serial capacitance element 922, the inductance value of the first parallel inductance element 920 and the inductance value of the second parallel inductance element 921 are not limited by the values provided in the present disclosure, which can also be other values determined according to actual situations.

Figure 4:
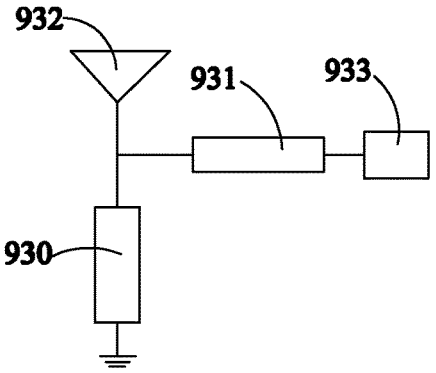
FIG. 4 is a structural schematic diagram of a matching network between a diversity antenna unit and a second radio frequency feeding end in an antenna system in accordance with an exemplary embodiment of the present disclosure.

FIG. 4 of the present disclosure shows a matching network between the diversity antenna unit 60 and the second radio frequency feeding end. The matching network includes a second parallel capacitance element 931, a third parallel inductance element 930, a third terminal 932 and a fourth terminal 933. The third terminal 932 is connected with the diversity antenna unit 60, the fourth terminal 933 is connected with the second radio frequency feeding end, and the second serial capacitance element 931 is connected in series between the third terminal 932 and the fourth terminal 933. An end of the third parallel inductance element 930 is connected with the system ground, the other end is connected with the second serial capacitance element 931. The capacitance value of the second serial capacitance element 931 can be 1.2 pF, the inductance value of the third parallel inductance element 930 can be 10 nH. It should be noted that, the capacitance value of the second serial capacitance element 931 and the inductance value of the third parallel inductance element 930 are not limited by the values provided in the present disclosure, which can also be other values determined according to actual situations.

Figure 5:
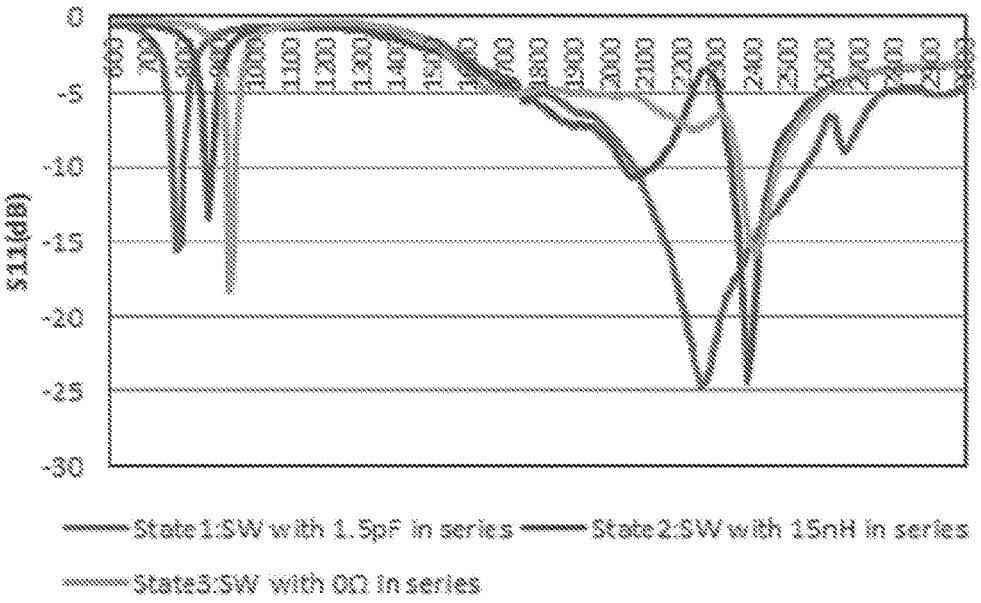
FIG. 5 is a graph showing return loss of a diversity antenna in an antenna system in accordance with an exemplary embodiment of the present disclosure.
Figure 6:
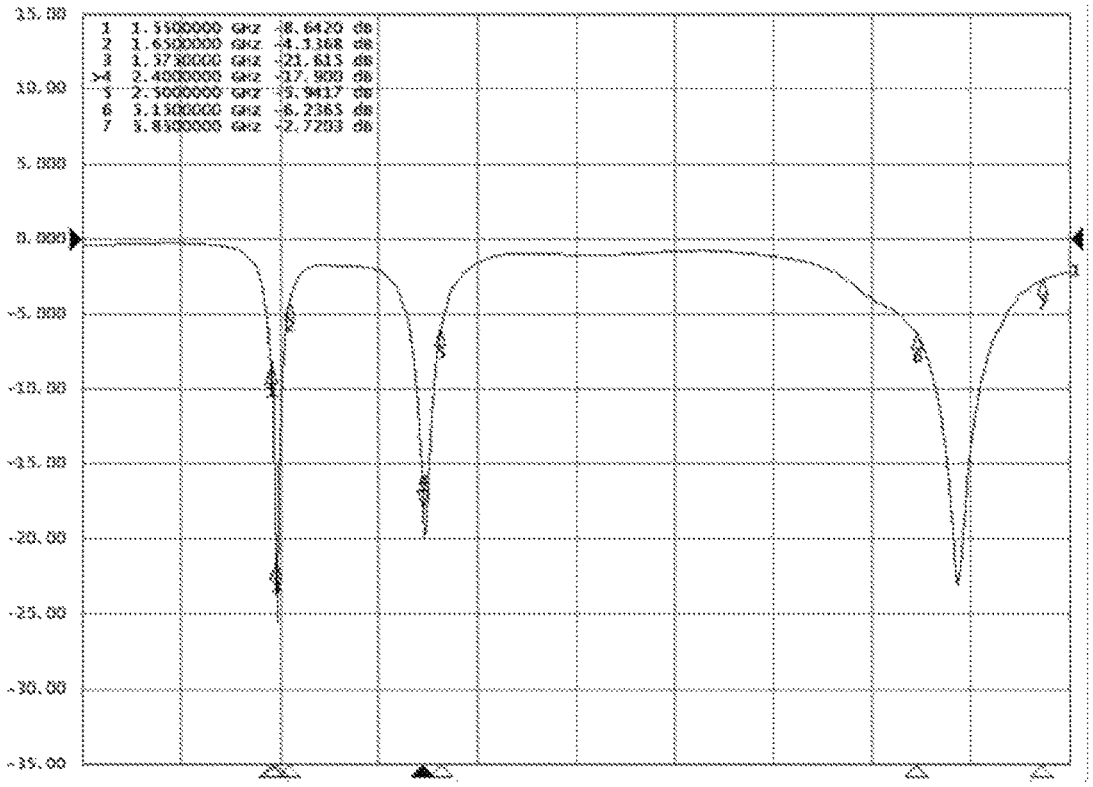
FIG. 6 is graph showing return loss of a three-in-one antenna in an antenna system in accordance with an exemplary embodiment of the present disclosure.
Figure 7:
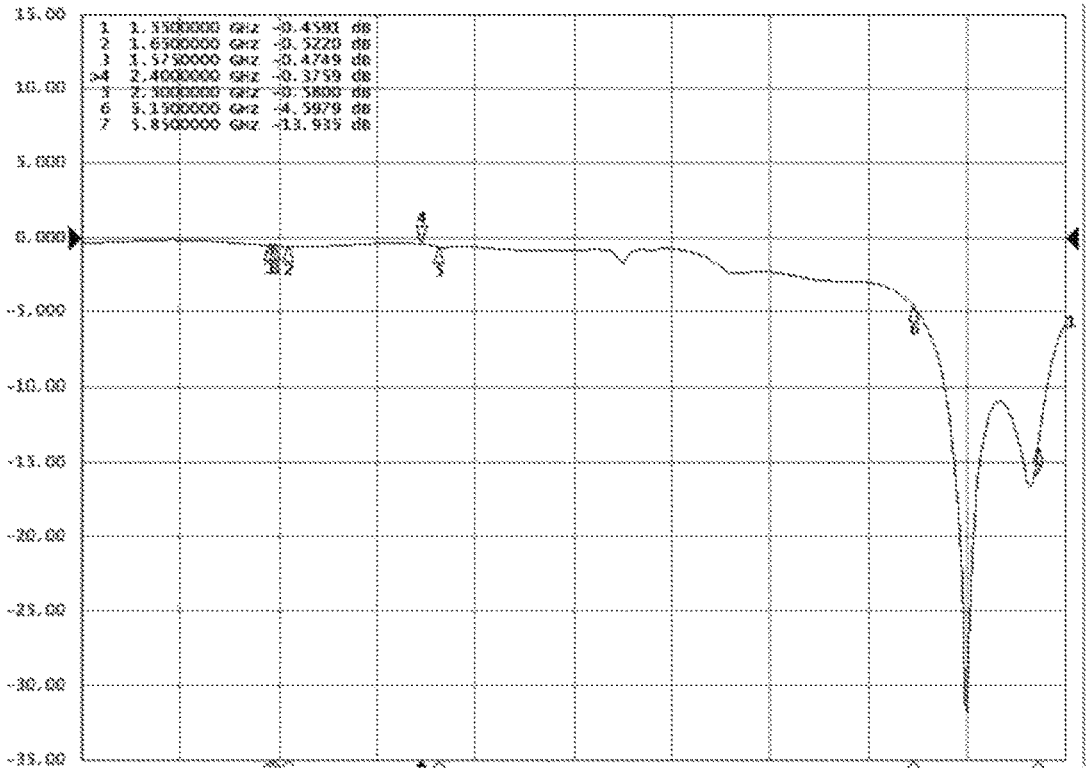
FIG. 7 is graph showing return loss of a WIFI 5G antenna in an antenna system in accordance with an exemplary embodiment of the present disclosure.
Figure 8:
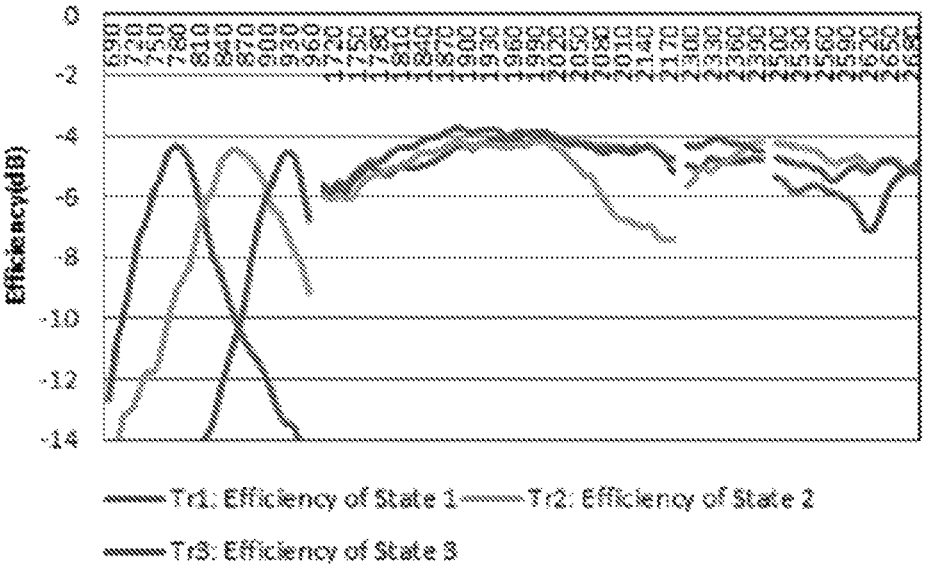
FIG. 8 is a graph showing radiation efficiency of a diversity antenna in an antenna system in accordance with an exemplary embodiment of the present disclosure.
Figure 9:
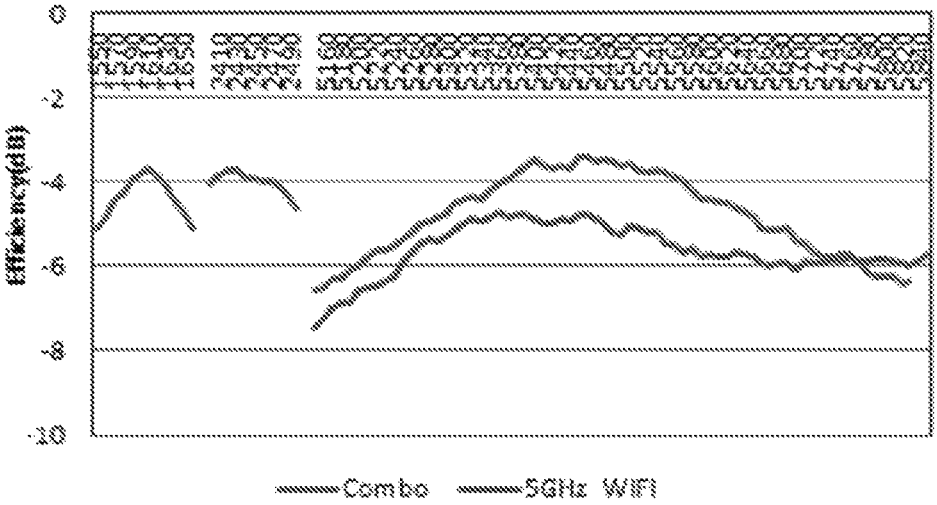
FIG. 9 is a graph showing radiation efficiency of a three-in-one antenna and a WIFI 5G antenna in an antenna system in accordance with an exemplary embodiment of the present disclosure.
Figure 10A:
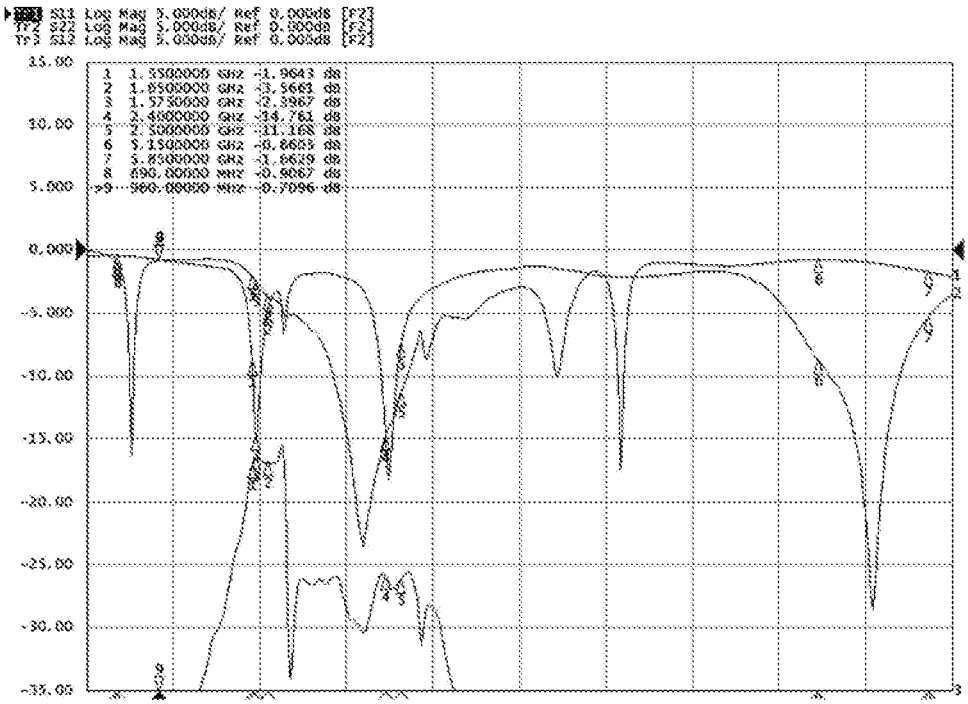
FIGS. 10*a*-10*c* are graphs showing transmission loss of a three-in-one antenna and a diversity antenna being in multiple different states in an antenna system in accordance with an exemplary embodiment of the present disclosure.
Figure 10B:
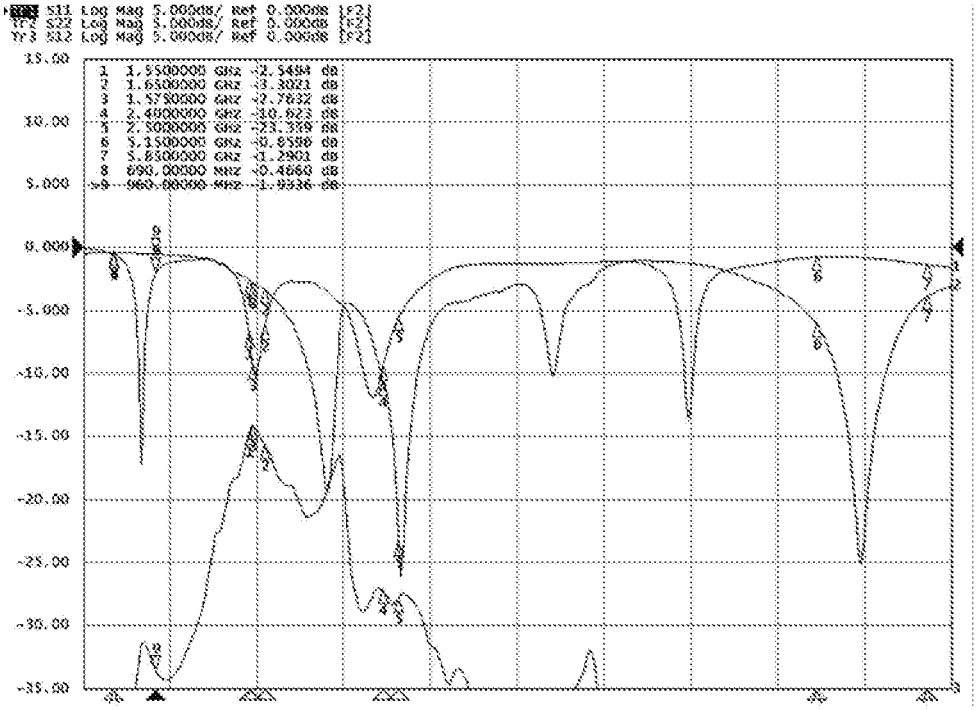
Figure 10C:
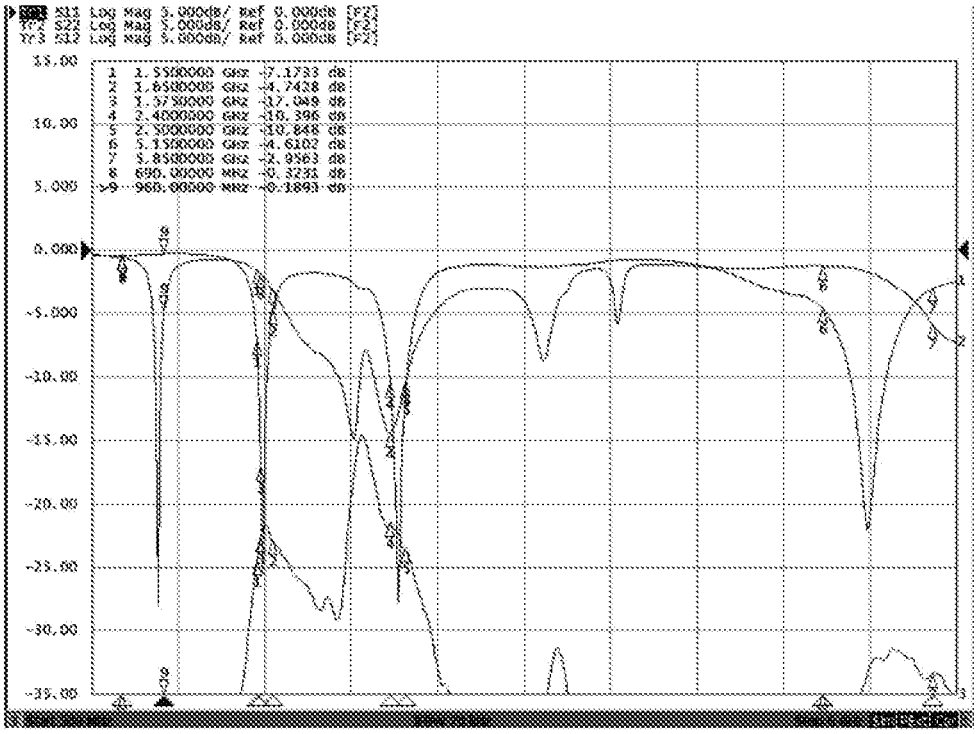
Figure 11:
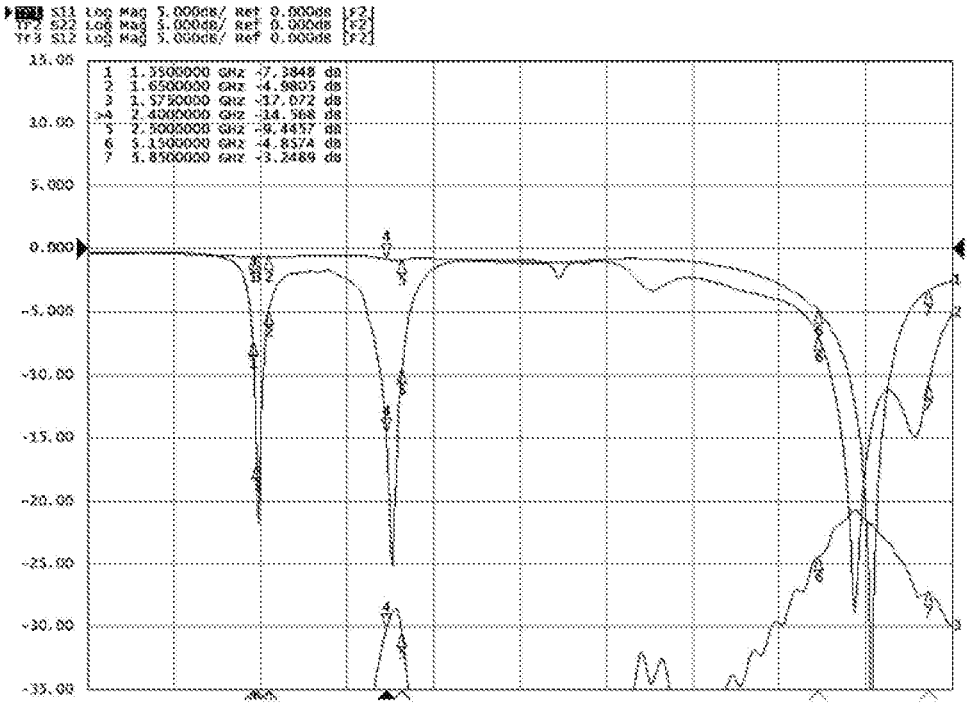
FIG. 11 is a graph showing transmission loss of a three-in-one antenna and a WIFI 5G antenna in an antenna system in accordance with an exemplary embodiment of the present disclosure.
Figure 12:
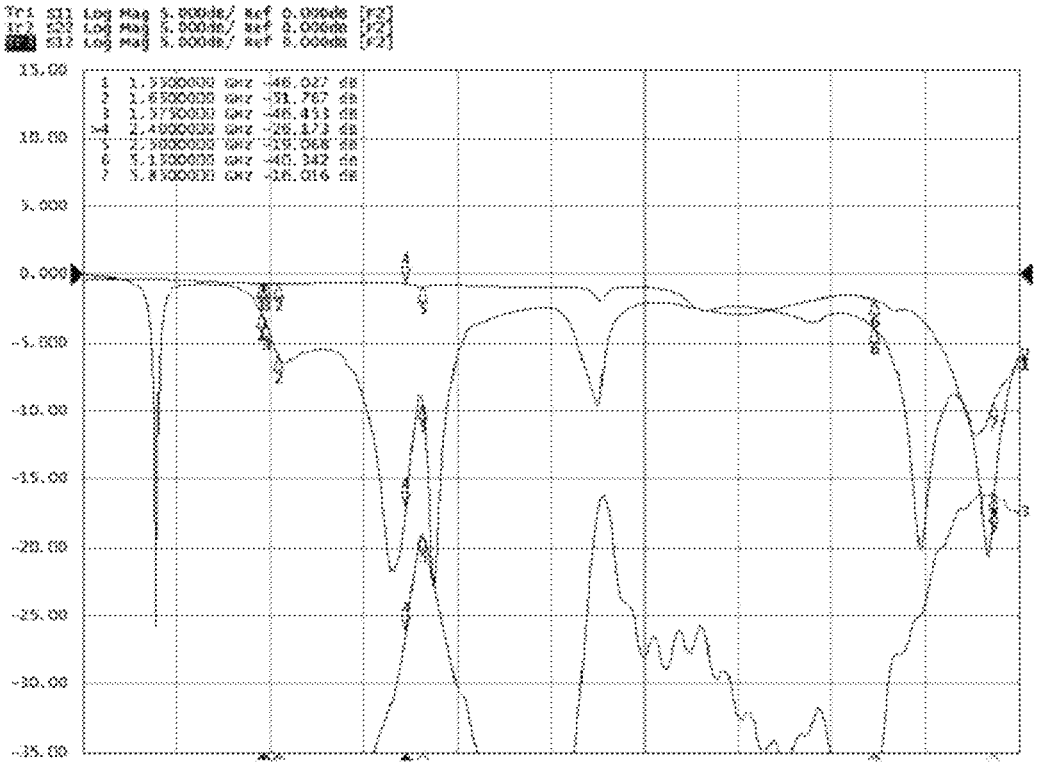
FIG. 12 is a graph showing transmission loss of a diversity antenna and a WIFI 5G antenna in an antenna system in accordance with an exemplary embodiment of the present disclosure.

The connection position of each antenna unit with the system ground can also be provided with lumped elements such as a resistance of 0Ω, a capacitance or an inductance, which allows adjustment of the antenna radiation performance. Based on the above-mentioned structure, return loss of the three-in-one antenna, the diversity antenna and the WIFI 5G antenna in the antenna system of the present disclosure is shown as FIG. 5, FIG. 6 and FIG. 7. Radiation efficiency of the diversity antenna is shown in FIG. 8, radiation efficiency of the three-in-one antenna and the WIFI 5G antenna is shown in FIG. 9. Transmission loss of the three-in-one antenna and the diversity antenna in multiple states is shown in FIGS. 10*a*-10*c*, transmission loss of the three-in-one and the WIFI 5G antenna is shown in FIG. 11, and the transmission loss of the diversity antenna and the WIFI 5G antenna is shown in FIG. 12.

Besides, the present disclosure also provides a mobile terminal, which includes the antenna system described in any one of the above-mentioned embodiments.

The above are just the preferred embodiments of the present disclosure, which will not limit the present disclosure. For those skilled in the art, the present disclosure can have various modifications and variations. Any modifications, equivalent replacements and improvements made within the spirits and principles of the present disclosure shall all fall in the protection scope of the present disclosure.

What is claimed is:

1. An antenna system, comprising:

a metal frame comprising a radiation portion and a grounding portion which are separately arranged, wherein a gap zone is defined between the radiation portion and the grounding portion;

a main board comprising a system ground, a first radio frequency feeding end and a second radio frequency feeding end;

a first conductive member;

a second conductive member;

a three-in-one antenna unit; and a diversity antenna unit;

wherein the three-in-one antenna unit is connected with the first radio frequency feeding end, and the diversity antenna unit is electrically connected with the second radio frequency feeding end;

the three-in-one antenna unit is connected with the radiation portion by the first conductive member, and the diversity antenna unit is connected with the radiation portion by the second conductive member, the radiation portion comprises a first grounding point and a second grounding point which are connected with the system ground, and the first grounding point and the second grounding point are arranged between the diversity antenna unit and the three-in-one antenna unit.

2. The antenna system as described in claim 1, wherein the gap zone comprises a first fracture and a second fracture arranged opposite to the first fracture, the three-in-one antenna unit is located between the first fracture and the diversity antenna unit, and the diversity antenna unit is located between the three-in-one antenna unit and the second fracture;

the first grounding point is closer to the three-in-one antenna unit, compared with the second grounding point;

the three-in-one antenna unit comprises a first sub-section and a second sub-section; one end of the first sub-section is connected with the radiation portion by the first conductive member, and the other end of the first sub-section is connected with the first radio frequency feeding end; the second sub-section comprises a connecting end and a free end, the connecting end is connected with the first sub-section, and the free end extends in a direction toward the first fracture.

3. The antenna system as described in claim 2, wherein the first sub-section and a portion of the radiation portion from the first grounding point to the first fracture generate a working frequency of a GPS antenna, the first sub-section and a portion of the radiation portion from the first conductive member to the first fracture generate a working frequency of a WIFI 2.4G antenna and a bluetooth antenna, the second sub-section and a portion on the first sub-section from the first radio frequency feeding end to the first connecting end generate a working frequency of a WIFI 5G antenna.

4. The antenna system as described in claim 1, further comprising: wherein the gap zone comprises a first fracture and a second fracture arranged opposite to the first fracture, the three-in-one antenna unit is located between the first fracture and the diversity antenna unit, and the diversity antenna unit is located between the three-in-one antenna unit and the second fracture; the second conductive member comprises a first conductive portion and a second conductive portion; the diversity antenna unit comprises a first sub-unit and a second sub-unit spaced from the first sub-unit, the first sub-unit is located between the second sub-unit and the second fracture, one end of the first sub-unit is connected with the second radio frequency feeding end, the other end of the first sub-unit is connected with the radiation portion by the first conductive portion, the second sub-unit comprises a connecting section and an extending section connected with the connecting section, the extending section extends in a direction away from the first sub-unit, one end of the connecting section is connected with the radiation portion by the second conductive portion.

5. The antenna system as described in claim 4, wherein the first sub-unit and a portion of the radiation portion from the first conductive portion to the second fracture generate a first working frequency;

the first sub-unit and a portion of the radiation portion from the second grounding point to the second fracture generate a second working frequency;

a portion of the radiation portion from the first conductive portion to the second conductive portion, the first sub-unit and the second sub-unit generate a third working frequency;

a portion of the radiation portion from the first conductive portion to the second conductive portion, the first sub-unit and the connecting section generate a fourth working frequency; and each of the first working frequency, the second working frequency and the third working frequency is less than the fourth working frequency; each of the second working frequency and the third working frequency are less than the first working frequency, and the second working frequency is less than the third working frequency.

6. The antenna system as described in claim 1, further comprising: a tuning switch, wherein the tuning switch is arranged between the second grounding point and the second conductive member, and the radiation portion is connected to the system ground by the tuning switch, wherein the first grounding point is closer to the three-in-one antenna unit, compared with the second grounding point.

7. The antenna system as described in claim 1, further comprising:

a WIFI 5G antenna unit;

a third conductive member; and a connecting member;

wherein the main board further comprises a third radio frequency feeding end, the WIFI 5G antenna unit is connected with the third radio frequency feeding end by the third conductive member, and the WIFI 5G antenna unit is connected with the system ground by the connecting member.

8. The antenna system as described in claim 7, wherein the WIFI 5G antenna unit and the radiation portion are spaced from each other.

9. The antenna system as described in claim 7, further comprising: a capacitance element, wherein the WIFI 5G antenna unit comprises a main branch, a first sub-branch, a second sub-branch and a third sub-branch, the first sub-branch, the second sub-branch and the third sub-branch are connected with the main branch, all the first sub-branch, the second sub-branch and the third sub-branch extend in a direction away from the radiation portion, and the second sub-branch is located between the first sub-branch and the third sub-branch, the first sub-branch is connected with the system ground by the capacitance element, the second sub-branch is connected with the third radio frequency feeding end by the third conductive element, and the third sub-branch is connected with the system ground by the connecting member.

10. A mobile terminal, comprising the antenna system as described in claim 1.

* * * * *